United States Patent [19]

Arnold et al.

[11] Patent Number: 4,970,481

[45] Date of Patent: Nov. 13, 1990

[54] CURRENT LIMITING CIRCUIT BREAKER CONTACT ARM CONFIGURATION

[75] Inventors: David Arnold, Chester; Yuet-Ying Yu, Danbury, both of Conn.

[73] Assignee: General Electric Company, New York, N.Y.

[21] Appl. No.: 435,637

[22] Filed: Nov. 13, 1989

[51] Int. Cl.[5] ..... H01H 75/00

[52] U.S. Cl. ..... 335/6; 335/16; 335/201

[58] Field of Search ..... 339/6, 16, 147, 195, 339/201; 200/147 R

[56] References Cited

U.S. PATENT DOCUMENTS

| | | | |
|---|---|---|---|
| 3,118,036 | 1/1964 | Gauthier et al. . | |
| 4,086,460 | 4/1978 | Gillette . | |
| 4,220,934 | 9/1980 | Wafer et al. . | |
| 4,375,021 | 2/1983 | Pardini et al. . | |
| 4,642,428 | 2/1987 | Yoshiyasu et al. . | |
| 4,649,243 | 3/1987 | Kralik . | |
| 4,652,975 | 3/1987 | Scott . | |
| 4,733,032 | 3/1988 | Pardini . | |
| 4,754,247 | 6/1988 | Raymont et al. . | |
| 4,761,626 | 8/1988 | Teraoka | 335/16 |
| 4,771,140 | 9/1988 | Fujii et al. . | |
| 4,789,848 | 12/1988 | Castonguay et al. . | |
| 4,806,893 | 2/1989 | Castonguay et al. . | |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A compact circuit breaker utilizing an electronic trip unit for overcurrent determination contains a compact slot motor and a compact arc chute to minimize and control the arc that occurs when the circuit breaker fixed and movable contacts become separated upon intense overcurrent conditions. The fixed contact is arranged on a fixed contact arm that includes an arc runner for rapidly directing the arc into the arc chute.

6 Claims, 2 Drawing Sheets

FIG. 3
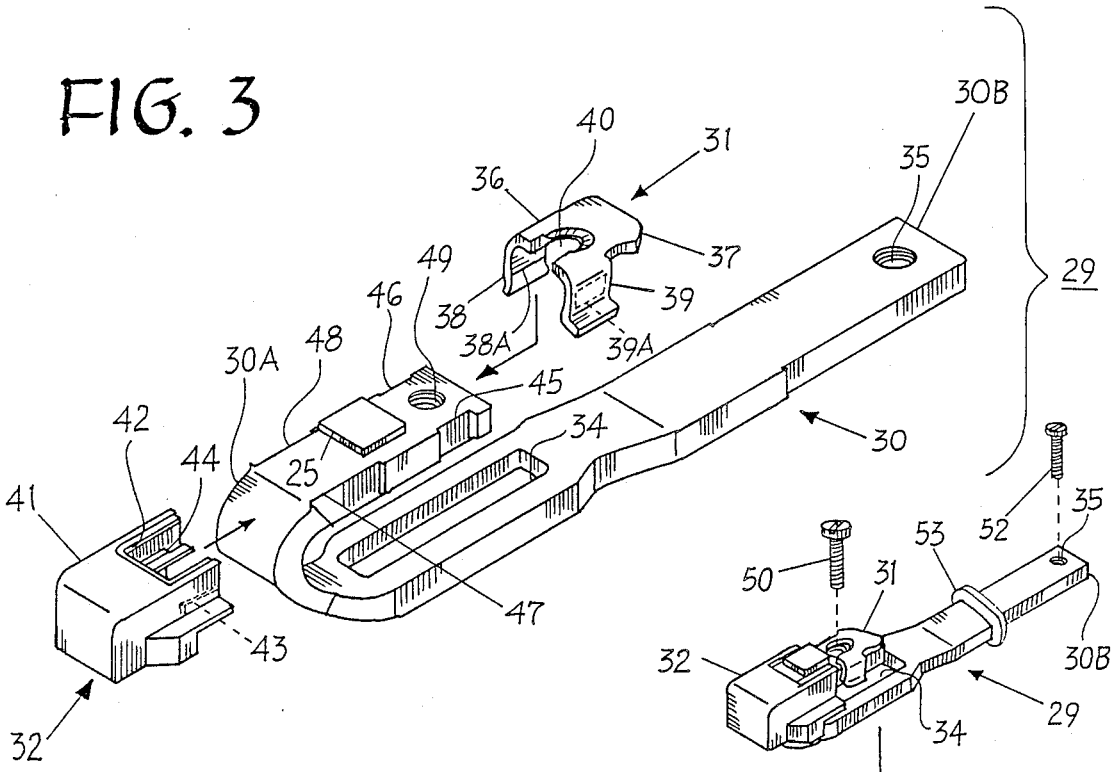
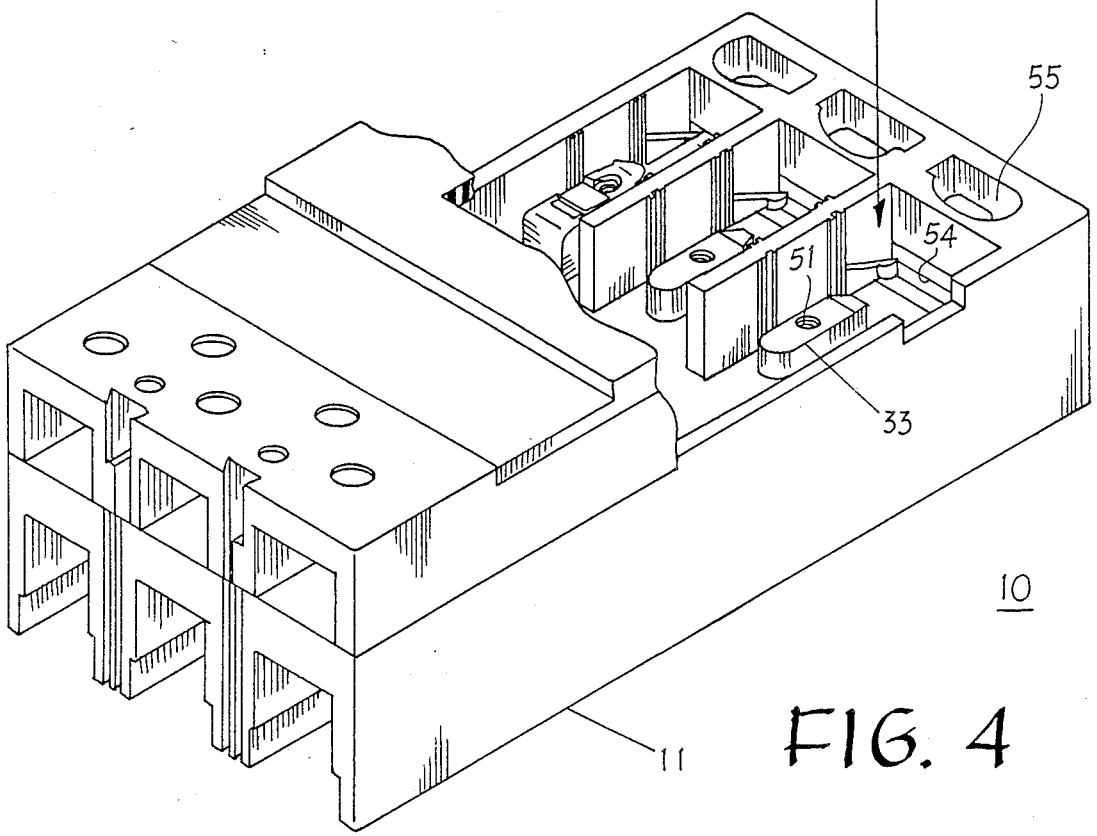
FIG. 4

CURRENT LIMITING CIRCUIT BREAKER CONTACT ARM CONFIGURATION

BACKGROUND OF THE INVENTION

An integrated circuit protection unit is defined as a circuit breaker that includes optional accessory protection features. One such integrated circuit protection unit is described in U.S. Pat. No. 4,754,247 which Patent is incorporated herein for reference purposes. The circuit breaker includes an accessory cover which is accessible for field-installation of selected accessory functions. The circuit breaker also includes an electronic trip unit in the form of a printed wire board positioned within a recess formed in the circuit breaker cover.

A current limiting circuit breaker utilizes the electromagnetic repulsion that occurs between the fixed and movable contact arms upon intense short circuit conditions to separate the circuit breaker contacts before the circuit breaker operating mechanism has time to respond. One example of a current limiting circuit breaker is described within U.S. Pat. No. 4,375,021 which Patent is incorporated herein for reference purposes. The arrangement of the slot motor to accelerate the movement of the movable contact arm allows the circuit to be interrupted in the early stages of the current wave form and hence limits the current to a reasonable value. The specially-designed arc chute in the aforementioned Patent rapidly quenches and extinguishes the arc that occurs during the rapid separation of the contacts. The complex design of both the slot motor and arc chute, however, do not readily allow for application within an automated circuit breaker assembly process.

An effective slot motor configuration for current limiting circuit breakers is described within U.S. Pat. No. 4,220,934 wherein the slot motor comprises a stack of U-shaped laminations of magnetic material fitted within a formed housing. The U-shaped laminations define a closed-ended and open-ended slot motor wherein the movable contact arm is driven toward the open end of the slot.

U.S. Pat. No. 4,733,032 describes an electric arc chute wherein the configuration of the arc plates and the composition of the arc chute support material are optimized to rapidly cool and extinguish the arc that occurs upon current limiting circuit interruption. This Patent is incorporated herein for reference purposes and should be reviewed for its description of the arc quenching properties of the specific plastic resin material used within the arc chute support.

When current limiting is attempted in certain lower-rated industrial molded case circuit breakers, problems occur due to the compact size limitations on the circuit breaker components and the circuit breaker enclosure, per se. It is difficult to contain the intense arc that is generated during the current limiting circuit interruption within the compact confines of the circuit breaker enclosure without causing damage to the enclosure. It is also difficult to quench and cool the arc because of the size restraints on the circuit breaker components within the enclosure since larger arc chute designs do not readily fit within the confines of the compact circuit breaker enclosure.

U.S. patent application Ser. No. 344,936 filed Apr. 8, 1989 and entitled "Compact Current Limiting Circuit Breaker" describes a compact slot motor as well as a compact arc chute configuration. With such compact arc chute configurations, it is important that the arc that occurs upon contact separation rapidly enters the arc chute for immediate cooling and deionization. One purpose of this invention is to provide a fixed contact arm arrangement that includes an arc runner intermediate the fixed contact and the arc chute to direct the arc into the bottom surface of the arc chute.

SUMMARY OF THE INVENTION

A compact circuit breaker employing a slot motor to rapidly separate the circuit breaker contacts further includes a fixed contact arm configuration containing a downwardly-curved arc runner for directing the arc that occurs upon contact operation into the bottom region of the arc chute for rapid arc extinction.

BRIEF DESCRIPTION OF THE DRAWINGS

FIG. 3 is a top perspective view in isometric projection of the fixed contact arm and arc runner within the circuit breaker of FIGS. 1 and 2; and FIG. 4 is a top perspective view of the contact arm and arc runner of FIG. 2 in isometric projection from the circuit breaker of FIG. 2.

DESCRIPTION OF THE PREFERRED EMBODIMENT

Figure 1:
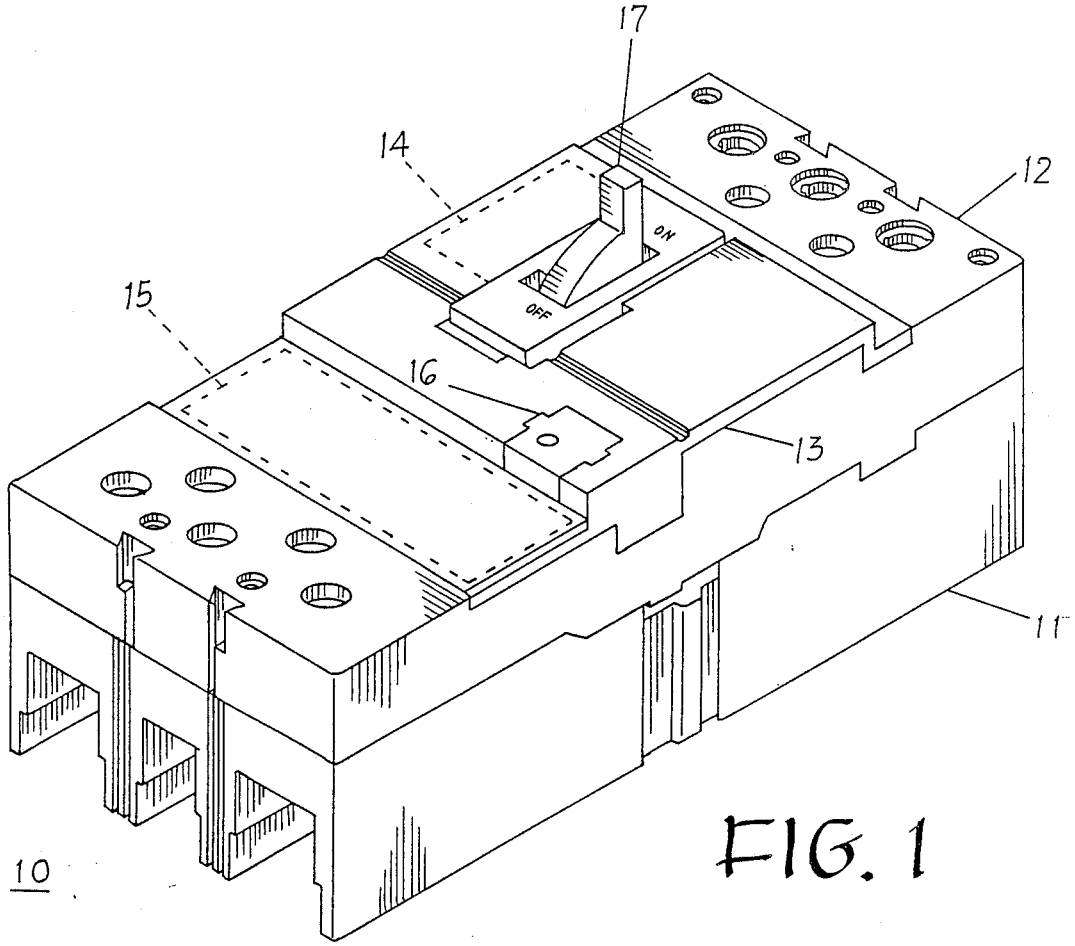
FIG. 1 is a top perspective view of a circuit breaker containing the fixed contact arm and arc runner configuration according to the invention.

An integrated circuit breaker 10 as shown in FIG. 1, consists of a case 11 to which a circuit breaker cover 12 is attached. The circuit breaker cover in turn is fitted with an accessory cover 13 for providing access to the trip actuator 14 and the trip unit 15 that are contained within the circuit breaker cover without interfering with the integrity of the circuit breaker operating components that are contained within the case 11. A rating plug 16 positioned within the accessory cover allows a standard-sized circuit breaker to be utilized over a wide range of ampere ratings by selecting the proper rating plug. The circuit breaker operating handle 17 allows for manual intervention for turning the circuit breaker contacts that are contained within the case to their ON and OFF positions.

Figure 2:
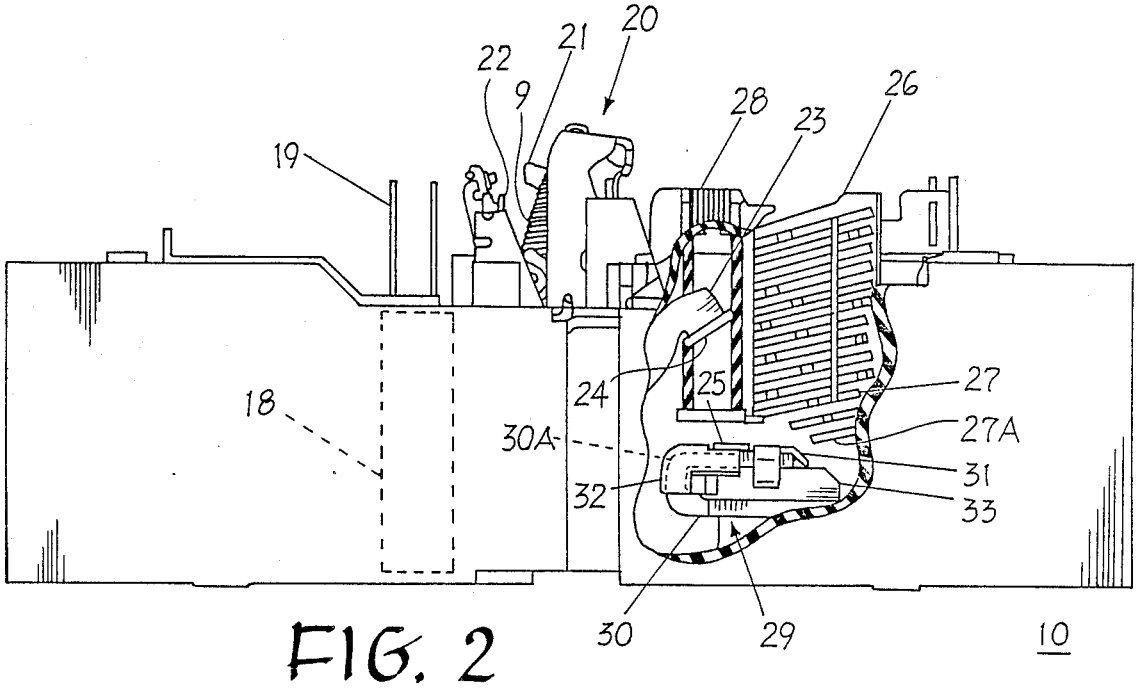
FIG. 2 is a side view of the circuit breaker depicted in FIG. 1 in partial section with the cover removed to show the configuration of the fixed contact arm and arc runner contained therein.

The circuit breaker 10 is depicted in FIG. 2 with the accessory cover, circuit breaker cover and part of the case removed to show the interaction of the various components contained therein. The circuit current is sensed within three current transformers, one for each phase of the protected circuit, one of which is represented at 18 for purposes of this disclosure. The current transformers interconnect with the trip unit 15 shown earlier in FIG. 1, by means of upstanding pins 19 in the manner described within U.S. Pat. No. 4,652,975.

The circuit breaker trip unit 15 of FIG. 1 interacts with the operating mechanism 20 by means of the trip actuator 14 also shown in FIG. 1. The trip actuator is described within U.S. Pat. No. 4,806,893, which Patent is incorporated herein for reference purposes and should be reviewed for the teachings contained therein. The operating mechanism is described within U.S. Pat. No. 4,789,848 and basically contains a cradle 21 and a latch 22 which restrain the powerful operating mechanism springs 9 from driving the movable contact arm 23 to the open position, depicted in FIG. 2 wherein the movable contact 24 is separated from the fixed contact 25 to interrupt the circuit current. The circuit current is also interrupted upon the occurrence of an intense short circuit condition whereby the movable contact arm becomes electrodynamically driven to its open position by operation of the slot motor 28. The current limiting aspect of the slot motor is described within the aforementioned U.S. Pat. No. 4,375,021. The intense arc that occurs when the contacts 24, 25 become separated upon overcurrent conditions is controlled within the arc chute 26 wherein the arc contacts the plurality of metal arc plates 27 to become cooled and quenched to complete the circuit interruption process.

To rapidly promote the transfer of the arc from the fixed contact 25 into the arc chute 26 the fixed contact arm assembly 29, supported on the base projection 33, includes a downwardly-turned arc runner 31 on the arc chute side of the fixed contact, whereby the arc becomes directed to the bottom-most arc plate 27A and immediately transfers upwards toward the remaining arc plates therein. To deter the transfer of the arc away from the arc chute, an insulative arc shield 32 is positioned over the U-shaped end 30A of the fixed contact arm 30 on the movable contact arm side of the fixed contact 25.

The fixed contact arm assembly 29 is assembled in the matter best seen by referring now to FIG. 3. The fixed contact arm 30 is arranged such that the U-shaped end 30A supports the fixed contact 25 while the opposite line strap end 30B includes a threaded aperture 35. An elongated slot 34 formed within the fixed contact arm supports the contact arm assembly within the circuit breaker case in a manner to be described below in greater detail. The fixed contact 25 is welded or brazed to a top part of the U-shaped end which also includes opposing grooves 45, 46, 47, 48 and a circular thru-hole 49. The arc shield 32 comprises a single body unit 41 formed of plastic and includes a planar slot 42 on a top surface thereof along with a pair of integrally-formed longitudinally extending detents 43, 44 as indicated. The arc shield is positioned over the U-shaped end and arranged such that the detents 43, 44 become trapped beneath the corresponding grooves 47, 48. The arc runner 31 is shaped from a single metal plate 36 to define a downwardly-turned projection 37 at one end and a radial slot 40 at an opposite end thereof. A pair of side pieces 38, 39 are arranged on either side of the slot and contain corresponding longitudinally extending detents 38A, 39A formed on an inner surface thereof for becoming trapped under the corresponding grooves 45, 46 on the U-shaped end of the fixed contact arm assembly. The radial slot 40 aligns with the thru-hole 49 on the fixed contact arm assembly for attaching the contact arm assembly to the circuit breaker case 11 as best seen by referring now to FIG. 4.

The fixed contact arm assembly 29 is positioned within the case by inserting the line strap end 30B within a slot 54 formed within the bottom of the circuit breaker case 11 of the circuit breaker 10. An elastomeric 0-ring 53 is positioned on the line strap end ahead of the threaded opening 35 to form an air-tight seal between the circuit breaker case and the outside environment. The elongated slot 34 is positioned about the projection 33 formed on the bottom surface of the circuit breaker case and a screw 50 is used to attach the contact arm assembly to the case by means of the threaded opening 51 formed in the top surface of the projection 33. The line terminal screw 52 threaded within the opening 35 after the line strap end is inserted through slot 54 allows for connection with the external circuit via the line terminal opening 55. When the contact arm assembly is thus secured within the case, the arc runner 31 faces the arc chute 26 and the arc shield 32 faces the movable contact arm 23 as shown in FIG. 2. Still referring to FIG. 2, it is noted that upon separation of the movable contact 24 from the fixed contact 25, the arc that occurs is directed to the bottom-most arc plate 27A because of the close proximity between the arc runner 31 and the bottom-most arc plate, as described earlier.

Having thus described our invention, what we claim as new and desire to secure by Letters Patent is:

1. A current limiting circuit breaker comprising:

a molded plastic case and cover;

a pair of separable contacts within said case controlled by an operating mechanism;

a movable contact arm supporting a movable one of said contacts and arranged for driving said movable contact to an open position upon the occurrence of a short circuit condition through said separable contacts;

a fixed contact arm supporting a fixed one of said contacts, said fixed contact arm including a line strap end and an opposing U-shaped end with an arc runner attached to said U-shaped end said arc runner including a slot through a top surface at one end, a downwardly-turned protrusion on an opposite end thereof and a pair of side pieces extending from said top surface, each of said side pieces including first detent means formed therein received within a first pair of opposing grooves on opposite sides of said U-shaped end;

an electronic trip circuit within said cover and arranged for articulating said operating mechanism upon occurrence of overcurrent conditions through said separable contacts to cause said movable contact to move to said open position; and an arc chute including a plurality of arc plates arranged proximate said fixed contact for receiving an arc generated when said contacts become separated and cooling and extinguishing said arc to completely interrupt circuit current through said contacts, said arc moving from said fixed contact to said arc chute by way of said arc runner.

2. The circuit breaker of claim 1 including an arc shield arranged on said U-shaped end at a side of said fixed contact opposite said arc runner, said arc shield including second detent means formed therein.

3. The circuit breaker of claim 2 wherein said U-shaped end includes a second pair of opposing grooves, said second detent means being retained within said second grooves to thereby retain said arc shield to said fixed contact arm.

4. The circuit breaker of claim 1 wherein said case includes a projection extending from a bottom thereof, and said fixed contact arm includes an elongated slot formed therein, said slot being arranged around said projection to support said fixed contact arm within said case.

5. The circuit breaker of claim 4 including a threaded opening within a top surface of said projection, said opening receiving a screw through said arc runner and through an aperture within said U-shaped end to fixedly hold said arc runner and said fixed contact arm to said case.

6. The circuit breaker of claim 5 including means on said line strap end of said fixed contact arm for receiving a line terminal screw.

* * * * *